United States Patent [19]

Morofuji et al.

[11] Patent Number: 5,065,183

[45] Date of Patent: Nov. 12, 1991

[54] MULTICOLOR PRINTING METHOD FOR CONTAINER

[75] Inventors: Akihiko Morofuji; Masaki Morotomi; Akihiko Machii; Masanori Aizawa, all of Kanagawa; Kazuhisa Ishibashi, Tokyo, all of Japan

[73] Assignee: Toyo Seikan Kaisha, Ltd., Tokyo, Japan

[21] Appl. No.: 368,382

[22] PCT Filed: Sep. 30, 1988

[86] PCT No.: PCT/JP88/00995

§ 371 Date: Jun. 2, 1989

§ 102(e) Date: Jun. 2, 1989

[87] PCT Pub. No.: WO89/03066

PCT Pub. Date: Apr. 6, 1989

[30] Foreign Application Priority Data

| | | | |
|---|---|---|---|
| Oct. 2, 1987 | [JP] | Japan | 62-247984 |
| Feb. 3, 1988 | [JP] | Japan | 63-21892 |
| Feb. 23, 1988 | [JP] | Japan | 63-38479 |

[51] Int. Cl.[5] ..... G03G 21/00

[52] U.S. Cl. ..... 355/202; 355/272; 355/285; 355/326

[58] Field of Search ..... 355/202, 210, 211, 272, 355/275, 280, 285, 289, 290, 327; 101/40, 136; 219/10.57-10.61, 243, 469-471; 346/157; 358/474

[56] References Cited

U.S. PATENT DOCUMENTS

| | | | |
|---|---|---|---|
| 3,115,091 | 12/1963 | Hakogi | 101/40 |
| 3,833,293 | 9/1974 | Serio et al. | 355/278 X |
| 4,041,901 | 8/1977 | Rarey et al. | 118/621 |
| 4,060,321 | 11/1977 | Butement | 355/211 |
| 4,239,370 | 12/1980 | Kurita | 355/326 |
| 4,319,111 | 3/1982 | Ishibashi | 219/10.69 |
| 4,448,872 | 5/1984 | Vandervalk | 355/295 X |
| 4,515,460 | 5/1985 | Knechtel | 355/327 |
| 4,531,828 | 6/1985 | Hoshino | 355/272 X |
| 4,588,279 | 5/1986 | Fukuchi et al. | 355/272 X |
| 4,755,849 | 7/1988 | Tarumi et al. | 355/290 |
| 4,809,037 | 2/1989 | Sato | 355/326 X |

FOREIGN PATENT DOCUMENTS

| | | |
|---|---|---|
| 0029043 | 3/1975 | Japan . |
| 0089036 | 7/1975 | Japan . |
| 0031190 | 3/1977 | Japan . |
| 0034805 | 3/1977 | Japan . |
| 0065566 | 5/1979 | Japan . |
| 0077187 | 6/1981 | Japan . |
| 0178787 | 11/1982 | Japan . |
| 0044446 | 3/1983 | Japan . |
| 0104673 | 6/1984 | Japan . |
| 0173980 | 8/1986 | Japan . |
| 0205143 | 9/1986 | Japan . |

*Primary Examiner*—A. T. Grimley
*Assistant Examiner*—J. E. Barlow, Jr.
*Attorney, Agent, or Firm*—Schwartz & Weinrieb

[57] ABSTRACT

A multicolor printing method for printing multicolor picture images upon a material or object to be printed comprises the steps of, in accordance with a first embodiment of the invention, the formation of a multicolor toner image upon a flexible belt by means of electrophotographic printing methods or techniques, and the transfer of such multicolor toner image directly to the material or object to be printed, such as, for example, a container made of, for example, metal, paper, plastic, glass, or the like, by means of a thermo-transferring process. In accordance with a second embodiment of the invention, the multicolor toner image is formed upon a plastic film, which is laminated upon the flexible belt, by means of electrophotographic printing methods or techniques, and the plastic film is then transerred to and fused upon the container. In accordance with a third embodiment of the present invention, a photoconductive member is irradiated by means of exposure light upon a rear surface thereof wherein the multicolor picture images are also formed by electrophotographic printing methods or techniques. In this manner, previously formed toner images upon the photoconductive member do not interfere with the image exposure processing.

24 Claims, 4 Drawing Sheets

MULTICOLOR PRINTING METHOD FOR CONTAINER

FIELD OF THE INVENTION

The present invention relates generally to color printing methods and processes, and more particularly to a multicolor printing process or operation to be performed upon a container, which may be fabricated from various materials, such as, for example, metal, glass, plastic, paper, or the like, by means of a single thermal transfer process utilizing electrophotographic printing technology.

BACKGROUND OF THE INVENTION

In general, the lithographic offset printing method and the letterpress printing method are well-known in the art as printing methods or processes for performing multicolor printing operations upon a container fabricated from various materials, such as, for example, metal, glass, plastic, paper, or the like. In accordance with the techniques characteristic of the lithographic offset printing method, ink adheres to a picture-line portion of a lithograph as a result of the picture-line portion of the lithograph being provided with a lipophilic property, while the non-picture-line portion of the lithograph exhibits or is provided with a hydrophilic property. The ink upon the lithograph is then transferred to a rubber blanket, and in turn, the ink disposed upon the rubber blanket is finally transferred to a material or object to be printed.

Similarly, in accordance with the techniques characteristic of the letterpress printing method, ink is applied to the picture-line portion which is provided upon a press in the form of a relief, and subsequently, the ink is transferred onto a material or object to be printed.

The aforenoted conventional printing methods, processes, and techniques are therefore appreciated as being superior in connection with the mass production of printed materials or objects, however, such methods or techniques do in fact require the pre-fabrication of the requisite printing plates or the like which of course entail considerable manufacturing costs, time, and labor, before the same are even used in connection with the actual printing operation to be performed upon the material or object to be printed. Accordingly, it can be further appreciated that such conventional multicolor printing processes or methods involve considerably or substantially more time and labor when it is in fact desired to print or register the respectively different colors of the multicolor printing operation upon the material or object to be printed.

Recently, electronic techniques have been developed within the printing technological field, such as, for example, the use of computerization, utilizing a layout scanner, in connection with an original manufacturing operation, and the development of a direct plate-making system for use within a plate-making process, however, techniques have nevertheless not as yet been developed for permitting elimination of the plate-making process per se for manufacturing the requisite printing plates, and consequently, the drawbacks and deficiencies of the prior art or conventional systems, processes, methods, and techniques still exist and remain.

Still further, in accordance with individual preferences, tastes, and pre-selected designs, there are increasing requirements for printing such various designs or indicia upon multiple kinds of materials and products, and consequently, it is becoming ever-increasingly more difficult to satisfy or achieve such requirements by means of such aforenoted conventional printing methods and techniques which are not particularly adaptable to readily alterable or adjustable printing functions or operations.

Considering then entirely different or alternate types printing techniques, such as, for example, those processes or techniques which do not require the use of printing plates, the electro-photographic printing method or the ink-jet printing method, also known as the non-impact printing technique, are in fact well-known. In accordance with these noted types of printing methods or techniques, a pictorial image can in fact be directly obtained by means of a pictorial image output from a computer without using a printing plate. In particular, the electrophotographic printing method has been widely utilized within photocopying machines, facsimile machines, and other types of printers whereby such method or technique has thus been employed in lieu of conventional printing methods or techniques.

More particularly, in accordance with a printing operation utilizing an electrophotographic printing method or technique, a surface of a photoconductive material is firstly uniformly charged, and subsequently, the surface is exposed from a position external to the photoconductive material so as to form an electrostatic latent image upon the surface of the photoconductive material. In order to then develop the electrostatic latent image and render the same visible, toner particles are deposited upon and adhere to the surface of the photoconductive material by means of a magnetic brushing method or technique, for example, whereupon, the toner particles are then transferred to a material or object to be printed and thermally fixed thereon, thereby completing the printing process.

When utilizing electrophotographic printing techniques in order to achieve multicolor printing processes, the multicolor printing process is performed and achieved by conducting an electrophotographic printing process utilizing a first color toner which, in accordance with the aforenoted techniques, is transferred to and fixed upon the material to be printed. Subsequently, the electrophotographic printing process is repeated so as to successively deposit, transfer, and fix other color toners upon the particular material being printed.

While the foregoing process or technique initially appears to be capable of being readily achieved or performed, the adaptation of such electrophotographic printing techniques in connection with multicolor printing processes does in fact involve substantial problems. For example, the process of transferring the toner image to the material or object being printed is very difficult to achieve, particularly in the case wherein the material or object to be printed is in fact a container. This is appreciated as being true because the transfer process is performed electrostatically wherein a gap exists or is defined between the toner image and the material or object being printed, in this case, the container. However, in view of the additional fact that the container may comprise one or more non-planar surfaces, it is very difficult to in fact achieve or define a constant gap space between the non-planar or curved surfaces of the container and the photoconductive drum upon which the toner image is formed.

Continuing further, in performance of a multicolor printing process, it is necessary, as has been noted hereinabove, to transfer toner images a multiplicity of times, that is, depending upon the number of color images or color components to be printed, and when the material or object to be printed is a container, it is quite difficult to properly register or align the container with the particular color image to be transferred thereto. In accordance with conventional techniques, a mark is usually applied to the material or object to be printed, and this mark is appropriately detected by suitable detection or sensing means, and accordingly, exposure for formation of the toner image is then conducted. However, in the instance that the material or object to be printed is a container, the mark detecting or sensing means, as well as the exposure means, is characterized by means of a relatively complex structure, and the registration or alignment process is quite difficult to achieve. Still further, in the instance wherein conventional electrophotographic printing techniques are utilized in conjunction with a metallic container, the photoconductive material may be damaged as a result of contact with the metallic container during the transfer process, and consequently, the photoconductive material may experience premature wear, and consequently, a substantially decreased service life.

Another conventional multicolor printing method, process, or technique utilized in conjunction with a material or object to be printed having a non-planar or curved surface is one in which a release agent is applied to a thin plastic film, called a base film, which is characterizied by means of a heat-resistant property; a color image picture is printed upon the base film by means of, for example, an offset printing method or process, or a gravure printing method or process; the base film, with the color image picture thereon, is then applied to the curved surface of the material or object to be printed; and a heated roll or roller is then pressed upon the rear surface of the base film so as to thereby transfer and fuse the thermoplastic resin forming the image picture from the base film onto the curved surface of the material or object being printed. This technique or thermo-transfer printing process is conventionally utilized as a printing method by means of which an image can be printed upon a surface having a complex curvature and upon which, or in connection with which, printing techniques utilizing a conventional press cannot be employed.

It is to be further realized or appreciated, however, that with the aforenoted thermo-transfer printing process or method, a plate is nevertheless utilized or still required in order to form the picture image upon the base film, and consequently, this method is characterized by means of the same problems or deficiencies noted hereinabove in connection with the plate-making procedures, as well as the registration of the respective colors forming the multi-color picture or image to be printed upon the material or object being printed. In addition, there is also a need or problem concerning disposal of an expensive base film.

OBJECTS OF THE INVENTION

Accordingly, it is a primary object of the present invention to provide a new and improved multicolor printing method or technique wherein the aforenoted problems characteristic of the conventional or prior art methods, processes, and techniques are overcome or obviated.

Another object of the present invention is to provide a new and improved multicolor printing method or technique which is capable of enabling a multicolor printing operation to be easily carried out or performed at a relatively high rate of speed and upon a material or object to be printed which may be in the form of a container fabricated from a suitable material chosen from the group comprising metal, glass, plastic, paper, or the like.

Still another object of the present invention is to provide a new and improved multicolor printing method or technique which is capable of instantaneously printing image or pictorial information from an original which is stored within a computer, whereby a printing plate or the like is obviated and accordingly rendered unnecessary.

Yet another object of the present invention is to provide a new and improved multicolor printing method or technique which is capable of printing an image or picture upon a material or object which is characterized by means of a curved surface.

SUMMARY OF THE INVENTION

The foregoing and other objectives of this invention are achieved by the provision of a multicolor printing method or technique which is characterized by the fact that a toner picture image of a first color, formed upon a photosensitive drum by means of an electrophotographic printing method, is transferred to and fixed upon a flexible conveyor belt; toner picture images of successive or additional colors are similarly transferred to and fixed upon the moving flexible conveyor belt in a repetitive manner so as to successively overlap the previously transferred and fixed toner picture images and thereby form a composite multicolor toner picture image upon the moving flexible conveyor belt; and a material or object to be printed, such as, for example, a container fabricated from a suitable material, such as, for example, metal, glass, plastic, paper, or the like, is pressed into contact with the belt under thermal conditions whereby the composite multicolor toner picture image is transferred from the movable flexible belt and fixed upon the surface of the container being printed.

In accordance with another aspect or embodiment of the present invention, there has been developed a multicolor printing method or technique which is characterized by the fact that a plastic film is removably laminated upon the movable flexible conveyor belt; a toner picture image of a first color, formed upon a photoconductive drum by means of an electrophotographic printing method, is transferred to and fixed upon the plastic film; toner picture images of successive or additional colors are similarly transferred to and fixed upon the plastic film in a repetitive manner so as to successively overlap the previously transferred and fixed toner picture images and thereby form a composite multicolor toner picture image upon the plastic film; and a material or object to be printed, such as, for example, a container fabricated from a suitable material, such as, for example, metal, glass, plastic, paper, or the like, is pressed into contact with the plastic film under thermal conditions such that the plastic film, carrying the composite multicolor toner picture image thereon, is transferred to and fused upon the surface of the container being printed.

In accordance with a still further aspect or embodiment of the present invention, there has also been developed a multicolor printing method or technique which is characterized by the fact that a photoconductive layer is laminated upon a cylindrical member fabricated from a light-transmissible electroconductive material so as to form an image carrier; the photoconductive layer is uniformly charged by means of a suitable charging device while the image carrier is rotated; an electrostatic latent image is formed upon the surface of the image carrier by irradiating the charged photoconductive layer by means of a light beam from a position internal of the image carrier; and the latent image is developed by means of a toner having a predetermined or first color pigment. The multicolor toner image is formed upon the image carrier by repeating the aforenoted processing steps with additional color toners, and the multicolor toner image is then transferred from the image carrier to a belt. In turn, the transferred image is thermally transferred and fixed upon a surface of the material or object to be printed, such as, for example, a container which may be fabricated from a suitable material, such as, for example, metal, glass, paper, plastic, or the like.

As can therefore readily be appreciated from the characteristic features of the present invention, that is, in either one of the instances wherein the multicolor image is formed upon the movable belt, or alternatively, upon the plastic film laminated upon the movable belt, since the electrophotographic printing method is utilized, the relative positioning or alignment of the respective color images is achieved by means of detecting the registration points formed upon the movable belt which is moving at a predetermined speed, and the image outputs from the computer are synchronized by means of the detected signals, thus forming the composite picture image upon the photoconductive drum. The photoconductive drum, upon which the composite picture image is formed, the movable belt, and the plastic film removably laminated upon the movable belt, are similarly disposed in a relatively synchronized manner, and the composite picture image is transferred onto the movable belt or onto the plastic film laminated thereon. Accordingly, by forming the picture images representing the various respective colors upon the belt in a repetitive manner, the composite multicolor picture image can in fact be obtained without encountering any adverse or detrimental positional shifting. The multicolor image printing can also of course be carried out or achieved by means of a single thermal transfer process so as to in fact thermally transfer the multicolor picture image onto, for example, the container object to be printed. Consequently, repetitive heating and cooling processes conventionally performed upon materials or objects being printed with multicolor picture images can in fact be eliminated or obviated whereby the process or technique of the present invention results in a substantial savings in energy and also facilitates high-speed operation and production.

In addition, in view of the thermal transfer printing process characteristic of the present invention, printing of the multicolor picture images upon a container having, for example, curved or non-planar surfaces, is able to be readily and easily achieved. In connection with such printing techniques, while conventional printing techniques can be adequately performed or achieved upon materials or objects having curved or non-planar surfaces when the particular picture image is monotone in color or has virtually no tone or shading gradations, to the contrary, in accordance with or by means of the present invention, it is possible to achieve fine dot or halftone printing.

Still further, since the electrophotographic printing method is utilized for the formation of the picture image, it is possible to eliminate the plate-making process, and therefore, the image information can be readily or instantaneously printed from the original pictorial image data stored within the computer. The registration of the multicolor printing images can be easily achieved, as can any color corrections, and consequently, the printing of small numbers or amounts of various different products can in fact be performed within an extremely short period of time.

Still yet further, in the instance that the picture image is transferred along with or upon the plastic film, the image transfer is instantaneously and completely achieved, and in addition, the printed surface developed upon the material or object being printed has substantial inherent strength. Accordingly, when the object being printed is, for example, a container, such as, for example, a metal can, a finishing varnish is generally applied to or coated upon the printed surface so as to protect the same after the printing operation has been completed, however, in accordance with the features, characteristics, and attributes of the printing method and techniques of the present invention, such a protective varnish or coating process is rendered unnecessary and can be eliminated.

Continuing still yet further, it is additionally noted that in accordance with the present invention printing method or processing techniques, exposure of the photoconductive layer is performed from a position internally of the image carrier, and consequently, the irradiating light beam is not required to pass through the toner image. Accordingly, the exposure of the photoconductive layer is not shield by or interfered with by means of the toner image whereby the color picture image is able to be achieved with enhanced clarity, preciseness, and resolution.

Lastly, it is again emphasized that in view of the fact that the transfer process in connection with the toner images onto the material or object to be printed is performed through means of the movable flexible belt, the printing operation can in fact be easily and readily carried out and achieved even with respect to materials or objects to be printed wherein the same do not have any flat or planar surfaces.

BRIEF DESCRIPTION OF THE DRAWINGS

Various other objects, features, and attendant advantages of the present invention will be more fully appreciated from the following detailed description when considered in conjunction with the accompanying drawings, in which similar reference characters designate like or corresponding parts throughout the several views, and wherein.

DETAILED DESCRIPTION OF THE ILLUSTRATED EMBODIMENTS

Figure 1:
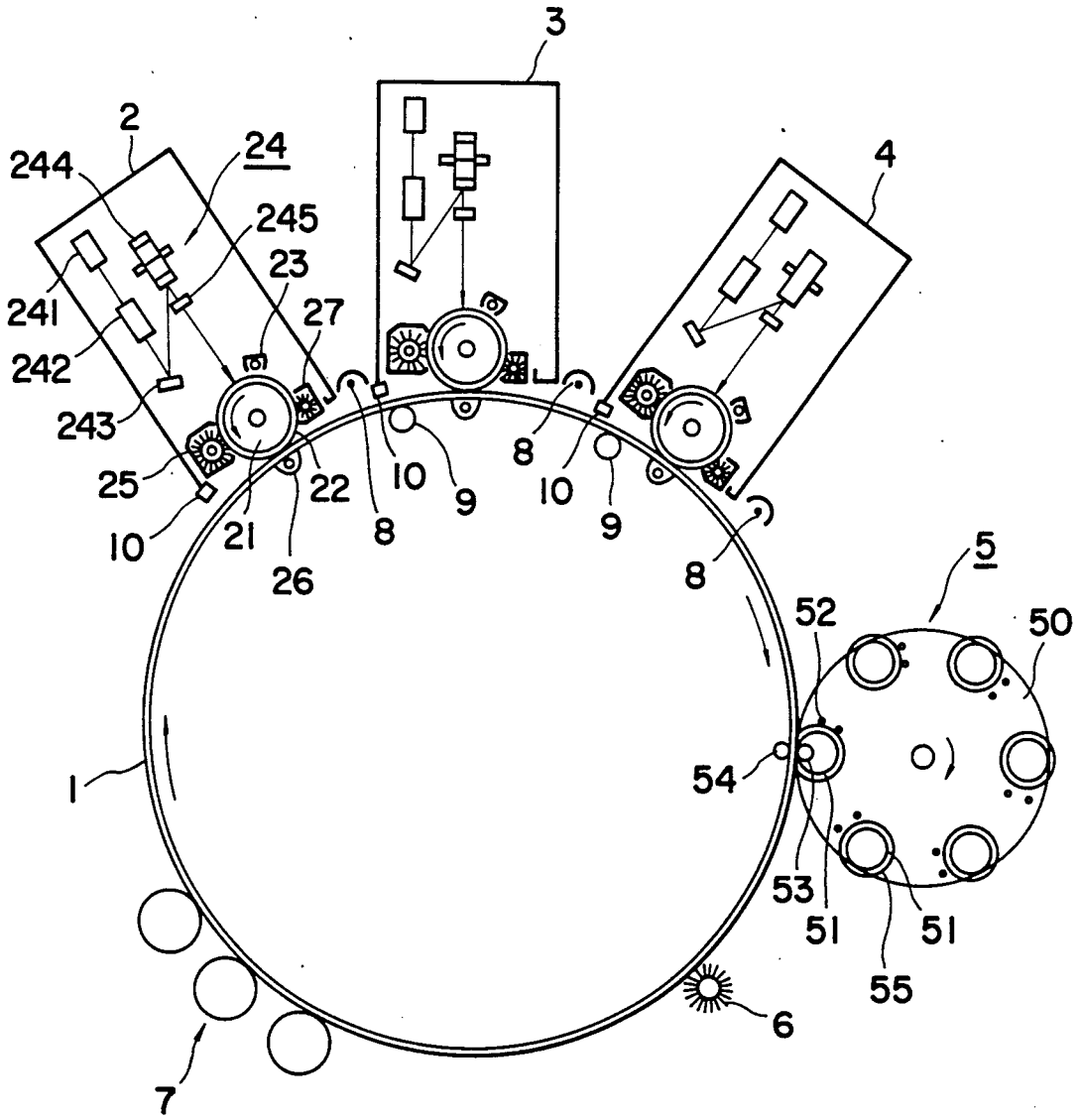
FIG. 1 is a schematic view of the primary components of a first embodiment of an apparatus system utilized for carrying out a multicolor printing method in accordance with the present invention.

Referring now to the drawings, and more particularly to FIG. 1 thereof, there is shown a first embodiment of an apparatus system for carrying out a multicolor printing method in accordance with the teachings of the present invention wherein a flexible belt 1, fabricated from a suitable electrically insulative material, is conveyed, by means of a feed roller and a guide, both of which are not shown, along a circular locus so as to pass initial; intermediate, and final electrophotographic units 2, 3, and 4, respectively, whereby a multicolor picture image is able to be formed upon the surface of the belt 1. The multicolor picture image formed upon belt 1 is, in turn, transferred to a material or object to be printed, and in the present instance, such material or object to be printed comprises, for example, a container 51, which may be fabricated from a suitable material, such as, for example, glass, metal, paper, plastic, or the like, and which is located at or mounted upon a thermo-transferring station or device 5 such that the containers 51 are disposed in tangential surface contact with the outer peripheral surface of belt 1. After transferrence of the multicolor picture image from the belt 1 to the container 51, the belt 1 is again circulated or driven along its circular locus by means of the aforenoted feed roller and guide means, not shown, so as to have new multicolor picture images formed thereon and transferred therefrom A cleaning brush 6 is disposed in tangential contact with an outer peripheral surface portion of belt 1 for cleaning the same, and a cooling device 7 is likewise disposed in tangential contact with another outer peripheral surface portion of belt 1 for cooling the belt after the multicolor picture image has been transferred from the flexible belt 1 to the container 51 at the thermo-transferring station or device 5.

The initial electrophotographic unit 2 includes an electrically conductive member 21 which comprises a drum around which is disposed a photoconductive material 22 which is formed as a laminate comprising layers of amorphous silicon, amorphous selenium, and a resin within which is dispersed zinc oxide or an organic photoconductive material, such as, for example, polyvinyl carbazole, phthalocyanine, or the like. Drum 21 is rotatably disposed adjacent to movable flexible belt 1 such that the photoconductive material 22 disposed therearound is rotatably disposed in contact with belt 1. Disposed about drum 21 and the photoconductive material 22 thereof, and at various circumferentially spaced stations located externally of the outer peripheral surface of drum 21 and material 22, there is provided a charging device 23 for initially charging the photoconductive material 22, an exposure device or system 24 for conducting laser beam radiation onto an outer peripheral surface portion of the photoconductive material 22 which was previously charged by means of charging device 23 whereby an electrostatic latent image is formed upon the photoconductive material 22, a developing device or station 25 at which toner materials are applied to the charged and exposed photoconductive material 22 so as to visually develop a picture image of the electrostatic latent image formed upon the photoconductive material 22, and a transferring device or station 26 for transferring the toner image from photoconductive member or material 22 to the flexible belt 1 by means of a suitable electrical field. A cleaning device 27 is also provided at an additional circumferentially located station for removing excess toner materials, remaining upon the photoconductive member 22, by means of a suitable brushing operation.

More particularly, the exposure device or system 24 is seen to comprise a laser beam oscillator or generator 241, a light modulator 242, a mirror 243, a rotary polygonal mirror 244, and an $f\theta$ lens unit 245. The laser beam emitted by means of the laser beam generator or oscillator 241 is modulated by means of the light modulator 242 in response to a signal received from an image memory unit, not shown, and in turn, the modulated laser beam is conducted toward and concentrated upon the photoconductive material or member 22 by means of the flat or planar mirror 243, the rotary polygonal mirror 244, and the lens unit 245 such that the laser beam impinges upon the photoconductive material or member 22 in a direction perpendicular or normal to an outer peripheral surface portion thereof as drum 21 and material 22 thereon rotate past the exposure station defined along the focal axis of lens unit 245.

Continuing further, the developing device 25 operates in such a manner that the magnetic toner materials, disposed upon tip portions of brush bristles projecting radially outwardly from a rotary sleeve rotating about a permanent magnet, come into contact with the outer peripheral surface of the photoconductive material or member 22 whereupon, the toner materials, which have been charged with a polarity which is opposite to that of the surface of the photoconductive material or member 22, adhere to the surface of the photoconductive material or member 22 by means of electrostatic attractive charge forces. In turn, the toner materials are transferred from the photoconductive material or member 22 to a peripheral surface portion of the movable flexible belt 1 as a result of the tangential surface contact defined between photoconductive member 22 and flexible 1 and under the influence of an electrical field generated by means of the transferring device 26. Toner materials remaining upon the photoconductive material or member 22 as residual toner materials are removed from the photoconductive material or member 22 by means of the cleaning device 27, and subsequently, the photoconductive material or member 22 is again uniformly electrically charged by means of the charging device 23 in preparation for the next image forming and printing operation.

The picture image transferred from photoconductive material or member 22 onto movable flexible belt 1 is then heated by means of a fixing or fusing device 8 comprising, for example, an infrared ray lamp partially surrounded by means of a parabolic mirror, so as to be fixed upon belt 1, as a result of belt 1 being rotated in the clockwise direction as viewed in FIG. 1 so as to move the picture image from the transfer station 26 to the fixing or fusing station 8. The belt 1 is subsequently rotated still further in the clockwise direction as viewed in FIG. 1 upon conclusion of the picture image fixing or fusing operation at station 8 so as to bring the belt 1 with the fixed or fused picture image thereon to a cooling station at which a suitable cooling device 9 is located for cooling the belt 1 and its associated picture image. More particularly, it is to be noted that in accordance with the present invention, the cooling device 9 comprises a water-cooled metallic roll or roller, and it is additionally noted that roll or roller 9 is disposed internally within enless circular flexible belt 1 so as to in fact be in peripheral contact with an inner peripheral surface portion of belt 1. In this manner, cooling device 9 can in fact impart cooling to belt 1 without contacting the picture image formed upon the opposite or outer peripheral surface of flexible belt 1.

Upon completion of the aforenoted processing of the picture image in connection with initial electrophotographic unit or station 2, the flexible belt 1 is moved or conveyed still further in the clockwise direction whereupon the belt 1 is successively treated or processed at intermediate and final electrophotographic units or stations 3 and 4 in a manner simlar to that performed in connection therewith at initial electrophotographic unit or station 2 whereby additional picture images are formed at such successive stations 3 and 4. It is particularly noted that the apparatus and structural components comprising subsequent stations 3 and 4 are the same as those incorporated within initial station or unit 2 with the only substantial difference residing in the fact that within initial electrophotographic station or unit 2 yellow toner materials are employed, whereas within intermediate and final electrophotographic stations or units 3 and 4, magenta and cyan toner materials are employed, respectively, the yellow and magenta toners of course having light transmissible properties.

Each of the electrophotographic units or stations 2, 3, and 4 are further respectively provided with detecting devices 10 which are disposed at leading end portions of the stations or units, as viewed the rotational direction of travel of the flexible belt 1 relative to the stations 2, 3, and 4, and such detecting devices are provided for generating detection signals which indicate registration points upon marked upon the belt 1 and which signals are transmitted to a computer which controls the exposure devices 24.

Continuing further with the description of the embodiment of the apparatus shown in FIG. 1, a thermo-transferring device, generally indicated by means of the reference character 5, is disposed downstream of the final electrophotographic station or unit 4, as viewed in the direction of movement of the flexible belt 1, and is seen to comprise an intermittently rotatable rotary table 50 upon which support devices 55 are disposed for supporting, carrying, and rotating a plurality of materials or objects 51 to be printed. Heating devices 52 are disposed upon rotary table 50 at positions radially outwardly of the materials or objects 51 to be printed for operative cooperation with the objects or materials 51 to be printed during the thermo-transferring operations to be performed upon or in connection with the materials or objects 51 to be printed, and a press roller 53 is also disposable interiorly of the material or object 51 being printed for rotatable cooperation with a pinch roller 54 which is disposed interiorly of the flexible belt 1. In this manner, both the flexible belt 1 and the material or object 51 to be printed have peripheral portions thereof in contact with each other and wherein further such peripheral portions are disposed within the nip defined between the pinch roller 54 and the press roller 53.

It is to be appreciated that the first embodiment of the present invention and having the foregoing construction operates as follows. In particular, the photoconductive material or member 22 disposed within the initial or first electrophotographic unit or station 2 is uniformly charged by means of the charging device 23, and when the charged photoconductive material layer 22 is exposed by means of the external exposure device 24 in correspondence or accordance with the picture image stored within the computer memory, the charged latent image corresponding to the picture image to be achieved is in fact formed. Yellow toner provided by means of the developing device 25 is then adhered to the charged electrostatic latent image formed upon the photoconductive material or layer 22 so as to render the latent image visible, and such yellow toned image is subsequently transferred from the photoconductive layer or material 22 to the movable belt 1 as a result of the presence of the electrical field generated by means of the transferring device 26. The toner picture image now present upon the flexible belt 1 is heated and fused by means of the infrared ray heating lamp of the fixing device 8 and is therefore fixed thereon. During subsequent similar processing within the second or intermediate electrophotographic unit or station 3 and the third or final electrophotographic unit or station 4, magenta and cyan toner images are fixed upon the belt 1 in a manner corresponding to the composite multicolor picture image to be obtained. Accordingly, the belt 1, upon which the composite multicolor picture image, comprising the three color toner images, is then transferred to the thermo-transferring device 5.

The registration for the complete or composite image formation within the respective electrophotographic units or stations 2, 3, and 4 is achieved by means of a picture image formation system which detects the registration marks formed upon the flexible belt 1, which is movable in the circumferential direction thereof at a predetermined speed, by means of the detection devices 10 whereby image signals are generated by means of the computer in response to the detected signals transmitted or generated by means of the detection devices 10. Accordingly, the picture images are formed upon the photoconductive member or material 22, and the formed images are transferred to the belt 1, in proper registration with respect to each other from the individual electrophotographic units or stations 2, 3, and 4 and upon the belt 1 as the final, completed, or composite picture image, in an extremely easy and precisely controlled manner.

Within the thermo-transferring device 5, the materials or objects 51 to be printed are intermittently fed by means of the rotary table 50, which in turn is driven by means of a feeding device or motor drive, not shown, such that a peripheral portion of each material or object 51 is disposed in contact with a peripheral portion of the flexible belt 1 whereupon the rotary drive or conveyance of the rotary table 50 is temporarily terminated. As has been noted hereinbefore, the peripheral portions of the flexible belt 1 and the materials or objects 51 are pressed into contact with each other, in a relatively rotatable manner, by means of the press roller 53 and the pinch roller 54. The material or object 51 disposed at this image transfer station is then heated to a predetermined temperature by means of high-frequency induction type thermo-transferring heating devices 52, in the instance wherein the material or object 51 is metallic, or alternatively by means of infrared ray type thermo-transferring heating devices 52 in the instance wherein the material or object 51 is fabricated from a suitable plastic or paper, such that the multicolor composite picture image formed upon the flexible belt 1 can in fact be readily thermally transferred onto the material or object 51 and in addition be fused thereon.

In connection with the use of the high frequency induction type thermo-transferring heating devices 52, an eddy current is induced within the material or object 51 as a result of the material or object 51 being disposed within the high frequency electrical field generated by means of the heating coil through which a high frequency current is passed, and accordingly, the material or object 51 is heated to a predetermined temperature by means of the Joule heat as is well-known. As a result of such high frequency induction heating process, the temperature control of the material or object 51 to be printed can in fact be easily controlled, and in addition, the material or object 51 can be uniformly heated within a relatively short period of time, whereby the colored composite picture image transferred to the material or object 51 being printed can in fact be fused thereon in an extremely precise manner. It is noted at this juncture of the detailed description of the present invention that in order to substantially insure the fact that the aforenoted thermo-transfer process can in fact be smoothly, readily, and precisely performed as desired by means of the thermo-transferring device 5, it is preferred that the material or object 51 to be printed be preliminarily coated with a suitable primer material which has characteristics similar to those of the binder contained within the toners of the composite color picture image, and in addition, to likewise coat the surface of the belt 1 with a suitable release agent whereby the easy and ready release of the composite toner image from belt 1 to the material or object 51 to be printed is in fact facilitated.

It is additionally noted that while the developing device 25 is a device of the type which is particularly adapted for use in connection with a dry-type development process in accordance with the embodiment of the present invention as described hereinabove, a developing device of the type which is likewise or alternatively adapted for use in connection with a liquid-type development process, wherein the toner particle, electrically charged, absorbing ions are dispersed throughout and suspended within an insulative liquid, such as, for example, a petroleum solvent, or an olefin solvent, such as, for example, isoparaffin, carbon tetrachloride, fluoride chloride ethylene, and cyclohexane, and wherein further, the toner particles adhere to the photoconductive layer by means of the Coulomb force generated by means of the electrical field or charged state characteristic of the electrostatic latent image, may likewise be employed in accordance with the teachings of the present invention.

It is furthermore noted that while in accordance with the particular exemplary description of the present invention, as set forth hereinabove, it was particularly noted that yellow, magenta, and cyan color toner materials were respectively employed within the first or initial, second or intermediate, and third or final electrophotographic units or stations 2, 3, and 4, the present invention is not in fact so limited and various modifications or variations of such sub-systems within the overall system or apparatus for carrying out the multicolor printing method or process of the present invention can of course be made. For example, the yellow color toner material may still be employed within the initial or first electrophotographic unit 2, however, cyan and magenta color toner materials may be respectively employed within the second or intermediate and third or final electrophotographic units or stations 3 and 4. Still yet further, the number of intermediate electrophotographic units or stations may be increased as desired, such as, for example, when it is desired or required to form the picture image with black toner.

The toners utilized within the electrophotographic units or stations 2, 3, and 4 of the present invention system are prepared by dispersing pigments, such as, for example, dis-azo yellow, carmine 6B, copper phthalocyanine, and carbon black, within a suitable binder, such as, for example, a wax, a thermoplastic resin, or a thermosetting resin. Examples of thermoplastic resins which may be employed in accordance with the teachings of the present invention include acrylic resins or polyester resins, while the thermosetting resins may include epoxy resins or polyurethane resins. Although not previously described or noted in connection with the previous detailed description of the apparatus and method of the present invention for achieving the multicolor printing process in accordance with the first embodiment of the present invention, it may be additionally desired or preferred to coat the surface of the printed material or object 51, such as, for example, the metal can, with a suitable finishing or protective varnish so as to in fact protect the toner picture image which has been transferred to and printed upon the metallic container. More particularly, it is noted that especially in the instance wherein the material or object 51 being printed comprises a metallic can or container, the printed toner layer is often likely to be damaged or have a tendency to deteriorate as a result of further process or use of the cans or containers. For example, upon completion of the toner picture image printing process in accordance with the present invention, the cans or containers will be conveyed to additional processing stations at which, for example, the cans or containers will be filled with particular contents, such as, for example, food products. While being conveyed to such additional processing stations, the cans or containers may encounter collisions with other cans or containers, or similar collisions with the various conveyor mechanisms, chute guides, or the like. As a result of such collisions, abrasion or peeling of the toner picture image upon the can or container may occur. In addition, in connection with the process of filling the can or container with, for example, food or other products, the can or container may be subjected to steam sterilization at a temperature of more than 100° C. as a result of which the toner picture image may be softened or suffer color deterioration. For these reasons, then, it is deemed necessary to in fact protectively coat the toner picture image layer with a suitable protective varnish or the like, and as an example of an acceptable protective or finish varnish, there may be used an acrylic resin, a polyester resin, an epoxy resin, an alkyd resin, an amino resin, or the like, with the acrylic and polyester resins in fact being preferred.

Figure 2:
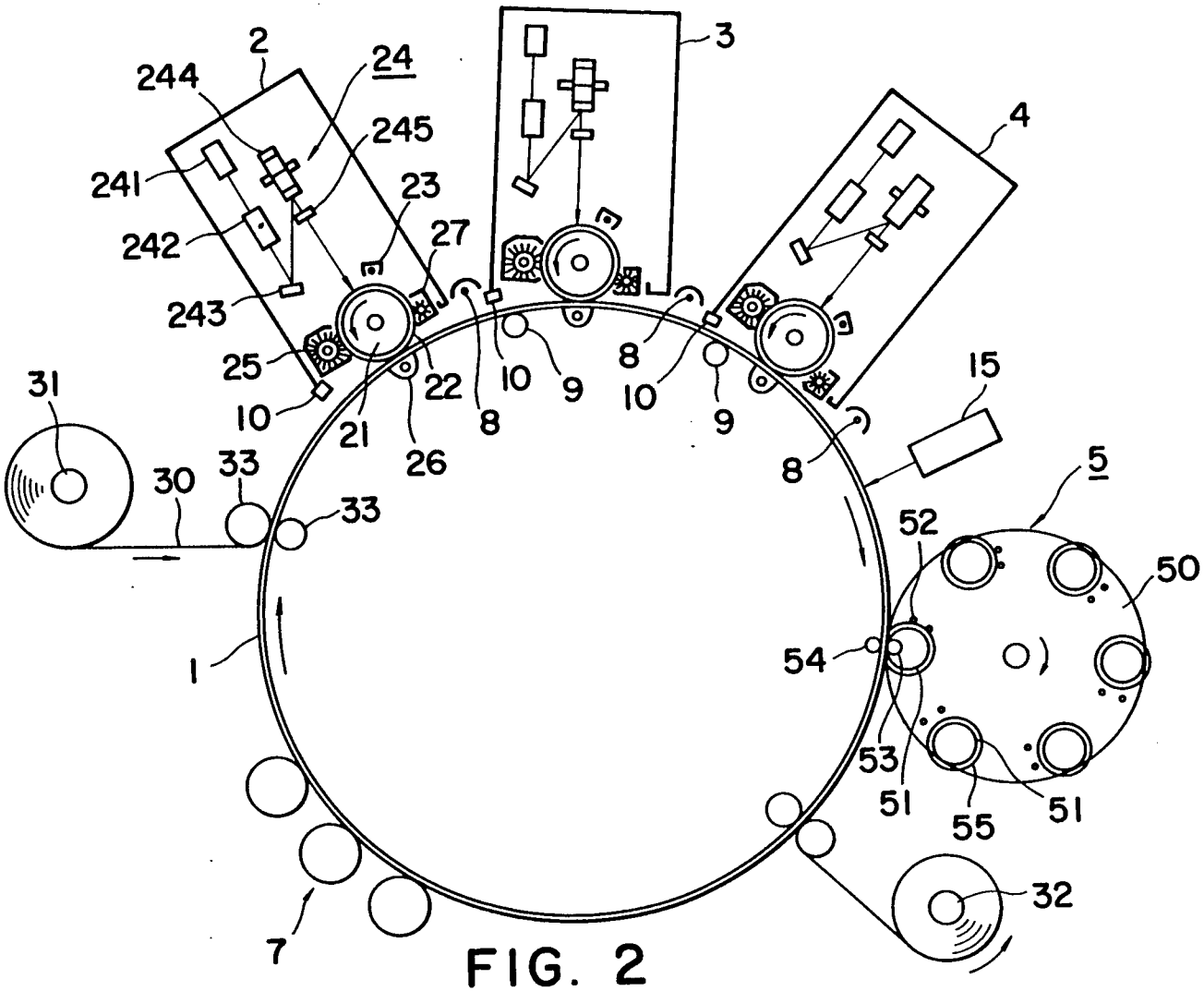
FIG. 2 is a schematic view of the primary components of a second embodiment of an apparatus system utilized for carrying out a multicolor printing method in accordance with the present invention.

With reference now being made to FIG. 2, a second embodiment of the present invention will be described. More particularly, reference numeral 1 designates a flexible metallic belt upon which a plastic film 30 is laminated, film 30 being supplied to belt 1 by means of an uncoiling supply spool 31, and laminated upon belt 1 by means of internal and external press rollers 33. As in the instance of the first embodiment of the present invention as described in connection with FIG. 1, belt 1, with plastic film 30 laminated thereon, is conveyed past initial or first, intermediate or second, and final or third electrophotographic units 2, 3, and 4 by means of a suitable feed roller and a guide means, not shown, so as to form a multicolor picture image upon the plastic layer 30. Only the picture image portion of the multicolor picture image is cut out of the laminated plastic film 30 by means of a suitable film cut-off device 15 which is disposed downstream of the final or third electrophotographic unit 4, and the severed picture image portion is then transferred and fused to the material or object to be printed, such as, for example, the container 51 which may be fabricated from either metal, glass, plastic, paper, or the like, by means of the thermo-transferring device 5. The cut-off device 15 may comprise, for example, a laser whereby irradiation of the plastic film 30 by means of a concentrated carbon laser beam achieves the desired cutting of the plastic film 30. The belt 1 is thereafter cooled by means of the cooling devices 7 interposed between the thermo-transferring device 5 and the plastic film supply spool 31, as a result of circumferentially conveying or circulating belt 1, and the residual portion of the plastic film 30, which was not fused upon the material or object 51 being printed but conveyed or circulated along with belt 1, is simultaneously, in effect, stripped from belt 1 and wound upon a coiler or storage reel or spool 32 disposed immediately downstream of thermo-transferring device 5.

It is noted that the construction or structural make-up of the initial or first, intermediate or second, and final or third electrophotographic units 2, 3, and 4; the process of forming the multicolor picture image upon the plastic film 30; the construction or structural make-up of the thermo-transferring device 5; and the printing mode whereby the picture image is fixed, along with the plastic film 30, upon the material or object 51 being printed, are all substantially the same as, or correspond to, the structural systems and processes previously discussed and described hereinbefore with respect to the first embodiment of FIG. 1, and consequently, further explanation of or elaboration upon the embodiment of FIG. 2 is deemed unnecessary, it being additionally noted that the same reference numerals have been used within or applied to the embodiment of FIG. 2, as were used within or applied to the embodiment of FIG. 1, to indicate like or corresponding parts thereof. It is further noted that with respect to the plastic film 30 employed within the embodiment of FIG. 2, it is desirable for the composition of the material comprising the plastic film 30 to exhibit high-strength characteristics under relatively high temperature conditions, and consequently, the plastic film 30 should be fabricated from a material chosen from the group of polycarbonate, polyethylene terephthalate, polypropylene, polyester, polyamide, polyimide, polyvinyl chloride, epoxy resins, acrylic resins, alkyd resins, or the like. Still further, the lamination process for the plastic film 30 may be performed by means of an extrusion coating of a thermo-plastic polymer or alternatively, by means of a lamination of the film thereof which may be carried out or achieved by means of either an inline or outline technique.

Figure 3:
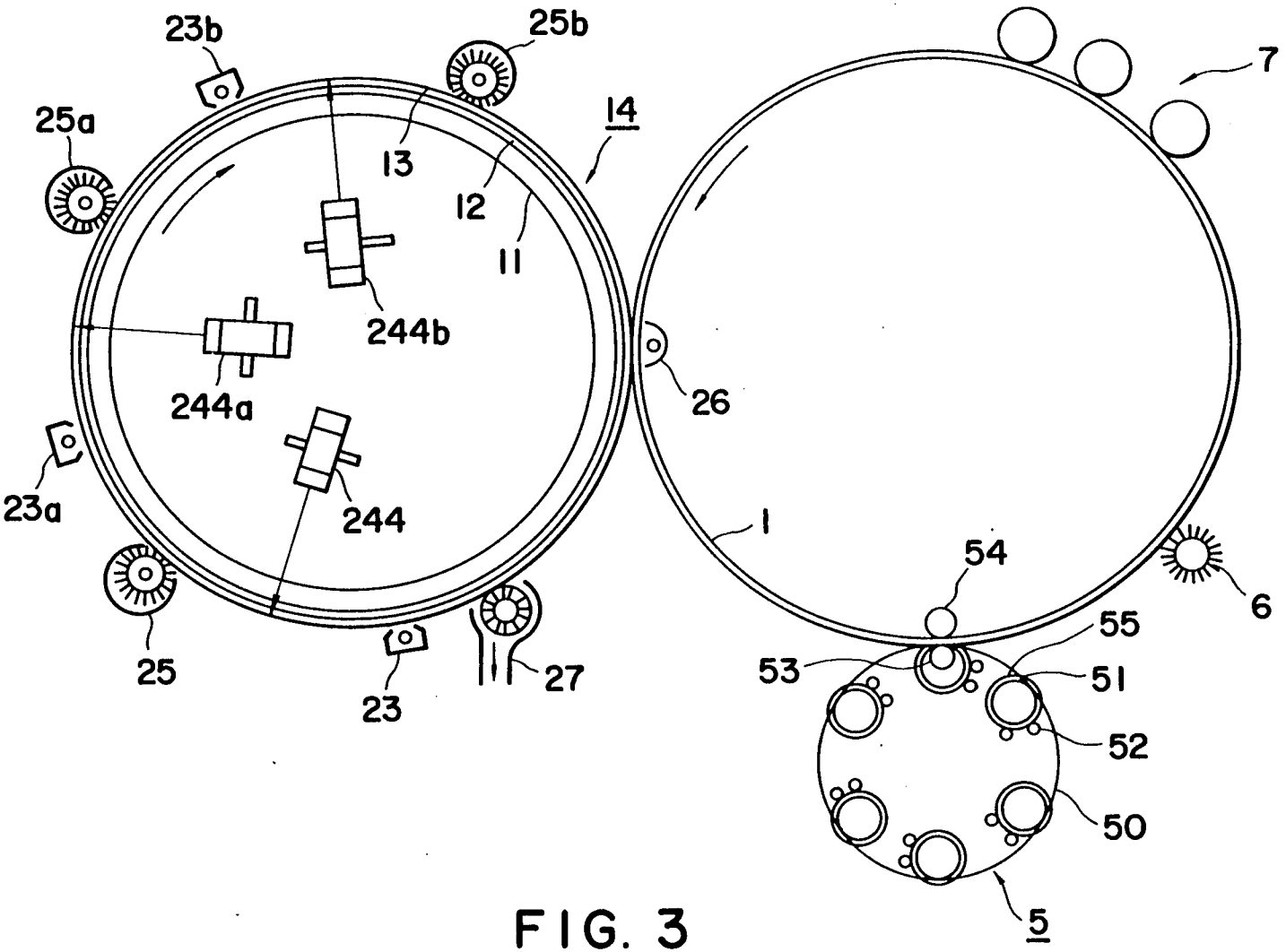
FIG. 3 is a schematic view of the primary components of a third embodiment of an apparatus system utilized for carrying out a multicolor printing method in accordance with the present invention.

With reference now being made to FIG. 3 of the drawings, a third embodiment developed in accordance with the principles of the present invention will now be described. In accordance with this embodiment, the apparatus is seen to be quite different from those shown and previously described in connection with the embodiments of FIGS. 1 and 2 to the effect that in accordance with the embodiment of FIG. 3, the formation of the multicolor picture image is achieved by means of an exposure device which is disposed interiorly with respect to an image carrier. More particularly, as seen in FIG. 3, reference numeral 11 designates a cylindrical supporting member having light transmissive properties, and an image carrier 14 is seen to comprise the supporting member 11 along with a light transmissible electroconductive member 12, disposed circumferentially about supporting member 11, and a photoconductive member or layer 13 which is, in turn, laminated upon or about electroconductive member 12. The image carrier 14 is circumferentially driven, by means not shown, at a constant rate of speed in the direction shown by means of the arrow.

It is preferred that the photoconductive layer 13 be fabricated from a suitable material, such as, for example, zinc oxide, titanium oxide, cadmium sulphide, amorphous silicon, selenium compounds, an organic photoconductive material, such as, for example, phthalocyamine compound, or the like, and similarly, it is preferred that the light transmissible electroconductive member 12 be fabricated from a suitable material, such as, for example, indium oxide, tin oxide, or the like.

Continuing further with the description of the third embodiment of the invention as disclosed within FIG. 3, reference numerals 23, **23*a*, and 23*b* designate electrical charging devices which uniformly charge the outer surface of the photoconductive layer 13 by means of a corona discharge, and reference numerals 244, 244*a*, and 244*b* designate rotary polygonal mirrors for use in connection with the respective exposure devices arranged interiorly within the image carrier 14 whereby laser beams, emitted in directions coming out of the plane of the drawings, are reflected by means of the mirrors 244, 244*a*, and 244*b* so as to expose photoconductive layer 13 and develop thereon electrostatic latent images which are to be subsequently developed as a result of the different color toners, such as, for example, yellow, magenta, and cyan, being applied thereto. More particularly, reference characters 25, 25*a*, and 25*b* designate developing devices circumferentially spaced about image carrier 14 at predetermined locations with respect to the corona charging devices 23, 23*a*, and 23*b*, as well as the exposure devices 244, 244*a*, and 244*b*, such that the respective color toners, that is, yellow, magenta, and cyan, are in fact applied to the photoconductive layer 13 so as to develop the electrostatic latent images previously formed thereon. As was the case with the previous embodiments, the developing devices 25, 25*a*, and 25*b* may comprise rotary brush devices whereby the magnetic toner materials are adhered to tip portions thereof, which come into contact with the photoconductive layer 13** so as to transfer the toner materials thereto, by means of rotating magnetic rollers.

A transferring device 26 is utilized in order to achieve transfer of the toner image from the image carrier 14 to the flexible belt 1 by means of electrostatic forces, and a cleaning device 27 is disposed downstream of the image transfer station defined between image carrier 14 and flexible belt 1, and as considered in the direction of rotary travel of the image carrier 14, so as to remove excess toner material from the image carrier 14 after transfer of the toner image from the image carrier 14 to the flexible belt 1.

In accordance with the operation or processing technique of the apparatus of the third embodiment of the present invention as illustrated and described in connection with FIG. 3, the surface of the image carrier 14, which has been previously cleaned by means of the cleaning device 27, is uniformly charged by means of the first charging device 23. An electrostatic latent image, subsequently corresponding to the yellow toner image, is initially formed upon the photoconductive layer 13 as a result of exposure of the same by means of the laser beam reflected thereon by means of the rotary polygonal mirror 244 wherein the reflected laser beam is transmitted to layer 13 through means of light transmissive supporting member 11 and light transmissible electroconductive member 12. The portion of the photoconductive layer 13 which is irradiated by means of the laser beam is therefore rendered electroconductive, and the charge upon the surface thereof passes to the light transmissible electroconductive member 12 whereby the electrostatic latent image, corresponding to the yellow toner image, is formed upon the surface of the image carrier 14. The yellow toner material, which is charged by means of the developing device 25 so as to have a charge opposite that of the electrostatic latent image formed upon the carrier 14, therefore adheres to the electrostatic latent image formed upon carrier 14 whereby the visible yellow toner image is formed upon carrier 14. In a similar manner, corresponding magenta and cyan toner images are formed in an overlapped manner upon the yellow toner image by means of the operative cooperation of the charging device 23*a*, rotary polygonal mirror 244*a*, and developing device 25*a*, and charging device 23*b*, rotary polygonal mirror 244*b*, and developing device 25*b*. In performance or achievement of these image development operations, the laser beams impinging upon the respective rotary polygonal are modulated by means of the corresponding picture image memory stored within the computer and are controlled in such a manner so as to be synchronized together during passage through the respective exposure portions of the image carrier whereby no color slippage, misalignment, or the like, occurs.

The multicolor picture image formed upon the image carrier 14 is subsequently transferred, by means of the transferring device 26, from the carrier 14 onto the flexible belt 1 which is fabricated from a suitable flexible insulating material, such as, for example, a silicone resin, a polyester resin, a fluoride resin, or glass fiber material containing a suitable resin, the belt 1 and the image carrier 14 being circumferentially conveyed, fed, or rotated at the same rate of speed. In turn, the multicolor toner picture image transferred onto the flexible belt 1 is then transferred by means of the thermo-transferring device 5, having a structure similar to that previously described in connection with the first and second embodiments of FIGS. 1 and 2, to the material or object 51 to be printed as a result of the operative cooperation of the heating devices 52, and the subsequent utilization of the press and pinch rollers 53 and 54. After the toner image upon the surface of the flexible belt 1 has been thermally transferred therefrom to the material or object 51 being printed, the surface of flexible belt 1 is cleaned by means of the cleaning device 6 and subsequently cooled by means of the cooling device 7 in preparation for the next printing operation.

Figure 4:
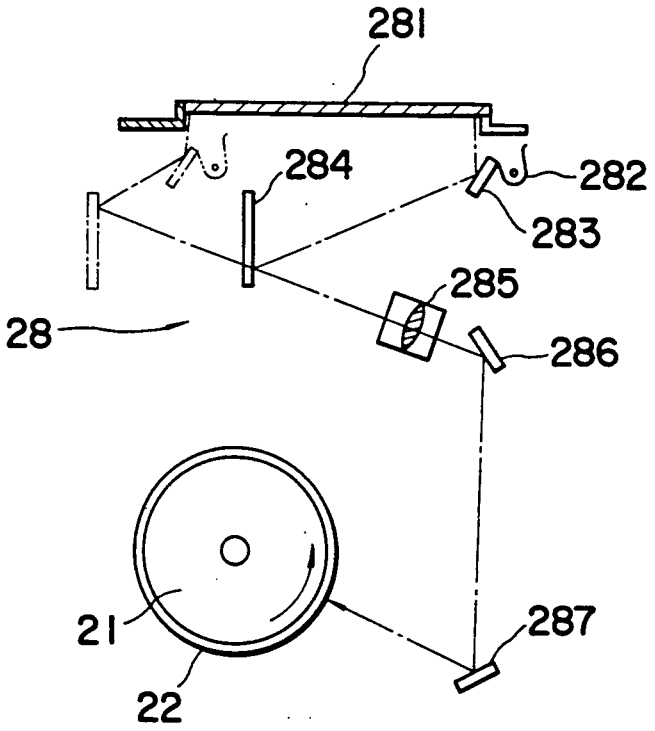
FIG. 4 is a schematic view of the primary components of an exposure system utilized in conjunction with the various apparatus systems disclosed within FIGS. 1-3.

With reference now being made lastly to FIG. 4 which illustrates an exposure device which can be substituted for the exposure devices heretofore described in connection with the various embodiment systems of FIGS. 1–3, it is seen that the exposure device, generally indicated by the reference character 28, comprises an original table 281 upon which original documents, for the respective color images to be formed or printed, are to be disposed, an exposure lamp 282, and a first mirror 283. These members or components are movable from the positions illustrated by means of the solid lines to the positions illustrated by means of the dotted or phantom lines at a constant rate of speed during an exposure operation, table 281 remaining fixed such that a relative scanning operation is achieved with respect to the original document disposed thereon by means of the movable light and mirror 282 and 283. A second mirror 284 is also movable along with first mirror 283 and lamp 282, and when the registration position upon the flexible belt 1 is detected by means of the detecting device 10, as was discussed in connection with the embodiments of FIGS. 1 and 2, the illuminating lamp 282 and the mirrors 283 and 284 begin to move from the illustrated solid line positions toward the illustrated dash line positions. As a result of such original document scanning operations, the illuminated image portions of the original documents mounted upon table 281 are transmitted to the photoconductive material 22 through means of the light path denoted by means of the dash lines, that is, from first mirror 283 to second mirror 284, a lens 285, and third and fourth mirrors 286 and 287, respectively. Within the exposure device 28, the exposure pattern comprises a scanning mode having a belt or strip configuration, whereas within the exposure device 24 of the first and second embodiments of FIGS. 1 and 2, the exposure pattern comprises a scanning mode having a dot or spot type configuration. Accordingly, the exposure process or operation performed by means of the exposure device 28 of FIG. 4 is substantially quicker and can therefore be performed in a substantially shorter period of time than that performed by means of the exposure device 24 of the first and second embodiments of FIGS. 1 and 2.

Obviously, many modifications and variations of the present invention are possible in light of the above teachings. It is therefore to be understood that within the scope of the appended claims, the present invention may be practiced otherwise than as specifically described herein.

We claim:

1. A multicolor printing method for printing multicolor matter upon a container, comprising the steps of:

forming a first toner picture image of a first color upon a photoconductive drum by means of an electrophotographic printing process;

transferring said first toner picture image of said first color from said photoconductive drum to a movable belt;

fixing said first toner picture image of said first color, transferred from said photoconductive drum to said movable belt, upon said movable belt;

forming at least one additional toner picture image of at least one additional color upon at least one additional photoconductive drum by means of an electrophotographic printing process;

transferring said at least one additional toner picture image of at least one additional color from said at least one additional photoconductive drum onto said movable belt such that said at least one additional toner picture image of said at least one additional color overlaps said first toner picture image of said first color in a predetermined registered manner so as to form with said first toner picture image of said first color a composite multicolor picture image;

fixing said at least one additional toner picture image, transferred from said at least one additional photoconductive drum to said movable belt so as to overlap said first toner picture image, upon said movable belt; and contacting said container with said movable belt under heated conditions so as to transfer said composite multicolor picture image from said movable belt to said container.

2. A method as set forth in claim 1, wherein:

said formation of said at least one additional toner picture image of at least one additional color comprises the formation of at least two additional toner picture images of at least two additional colors whereby said composite multicolor picture image comprises at least three toner picture images of at least three different colors.

3. A method as set forth in claim 1, wherein:

said container is fabricated from a material chosen from the group of metal, glass, plastic, and paper.

4. A method as set forth in claim 1, wherein:

said container is heated by means of an induction heating process so as to transfer said multicolor picture image from said movable belt to said container.

5. A method as set forth in claim 1, further comprising the step of:

coating said multicolor picture image surface of said container with a varnish finish, after said multicolor picture image has been transferred from said movable belt to said container, so as to protect said multicolor picture image fixed upon said container.

6. A method as set forth in claim 2, wherein:

said movable belt comprises an endless annular belt having a circular locus; and said first and at least two additional toner picture images are formed upon three photoconductive drums disposed at circumferentially spaced locations about said circular locus of said movable belt.

7. A method as set forth in claim 6, further comprising the steps of:

providing a plurality of containers upon an indexable rotary table; and intermittently rotating said movable belt along said circular locus in correspondence with an indexable movement of said rotary table so as to achieve said transfer of said multicolor picture images from said movable belt to said containers in a serial production manner.

8. A multicolor printing method for printing multicolor matter upon a container, comprising the steps of:

removably laminating a plastic film upon a movable belt;

forming a first toner picture image of a first color upon a photoconductive drum by means of an electrophotographic printing process;

transferring said first toner picture image of said first color from said photoconductive drum to said plastic film disposed upon said movable belt;

fixing said first toner picture image of said first color, transferred from said photoconductive drum to said plastic film disposed upon said movable belt, upon said plastic film disposed upon said movable belt;

forming at least one additional toner picture image of at least one additional color upon at least one additional photoconductive drum by means of an electrophotographic printing process;

transferring said at least one additional toner picture image of said at least one additional color from said at least one additional photoconductive drum onto said plastic film disposed upon said movable belt such that said at least one additional toner picture image of said at least one additional color overlaps said first toner picture image or said first color in a predetermined registered manner so as to form with said first toner picture image of said first color a composite multicolor picture image;

fixing said at least one additional toner picture image of said at least one additional color, transferred from said at least one additional photoconductive drum to said plastic film disposed upon said movable belt so as to overlap said first toner picture image of said first color, upon said plastic film disposed upon said movable belt; and contacting said container with said plastic film, disposed upon said movable belt, under heated conditions so as to transfer said plastic film, having said composite multicolor picture image formed thereon, from said movable belt to said container.

9. A method as set forth in claim 8, wherein:

said composite multicolor picture image is formed upon a predetermined portion of said plastic film;

said predetermined portion of said plastic film is severed from a residual portion of said plastic film by a cutting means prior to said transfer of said predetermined portion of said plastic film, having said composite multicolor picture image formed thereon, from said movable belt to said container; and said residual portion of said plastic film is removed from said movable belt subsequent to said transfer of said predetermined portion of said plastic film, having said composite multicolor picture image formed thereon, from said movable belt to said container.

10. A method as set forth in claim 9, wherein:

said plastic film, comprising said residual portion of said plastic film, and said predetermined portion of said plastic film upon which said composite multicolor picture image is to be formed, is supplied to said movable belt from a supply roll, and said residual portion of said plastic film is removed from said movable belt and coiled into a used film roll.

11. A method as set forth in claim 8, wherein:

said formation of said at least one additional toner picture image of at least one additional color comprises the formation of at least two additional toner picture images of at least two additional colors whereby said composite multicolor picture image comprises at least three toner picture images of at least three different colors.

12. A method as set forth in claim 11, wherein:

said movable belt comprises an endless annular belt having a circular locus; and said first and at least two additional toner picture images are formed upon three photoconductive drums disposed at circumferentially spaced locations about said circular locus of said movable belt.

13. A method as set forth in claim 12, further comprising the steps of:

providing a plurality of containers upon an indexable rotary table; and intermittently rotating said movable belt along said circular locus in correspondence with an indexable movement of said rotary table so as to achieve said transfer of said plastic films, having said multicolor picture images formed thereon, from said movable belt to said containers in a serial production manner.

14. A method as set forth in claim 8, wherein:

said container is fabricated from a material chosen from the group of metal, glass, plastic, and paper.

15. A method as set forth in claim 8, wherein:

said container is heated by means of an induction heating process so as to transfer said plastic film, having said composite multicolor picture image formed thereon, from said movable belt to said container.

16. A method as set forth in claim 8, further comprising the step of:

coating said plastic film, having said composite multicolor picture image disposed thereon, with a varnish finish, after said plastic film has been transferred from said movable belt to said container, so as to protect said composite multicolor picture image formed upon said plastic film and disposed upon said container.

17. A multicolor printing method for printing multicolor matter upon a container, comprising the steps of:

forming a first toner picture image of a first color upon a photoconductive drum by means of an electrophotographic printing process;

forming at least one additional toner picture image of at least one additional color upon said photoconductive drum by means of an electrophotographic printing process such that said at least one additional toner picture image of said at least one additional color overlaps said first toner picture image of said first color in a predetermined registered manner so as to form with said first toner picture image of said first color a composite multicolor picture image upon said photoconductive drum;

transferring said composite multicolor picture image from said photoconductive drum to a belt; and contacting said container with said belt under heated conditions so as to transfer said composite multicolor picture image from said belt to said container.

18. A method as set forth in claim 17, further comprising the steps of:

forming said photoconductive drum as a tubular laminate comprising an inner light-transmissible supporting member, a light-transmissible electroconductive member laminated upon said supporting member, and a photoconductive member laminated upon said electroconductive member; and said electrophotographic printing process comprises the steps of uniformly charging said photoconductive member of said photoconductive drum, forming an electrostatic latent image upon said photoconductive member by irradiating said charged photoconductive member with light from a position interiorly of said tubular photoconductive drum, and developing said latent image by depositing toner material of a predetermined color upon said latent image formed upon said photoconductive member.

19. A method as set forth in claim 17, wherein:

said formation of said at least one additional toner picture image of at least one additional color comprises the formation of at least two additional toner picture images of at least two additional colors whereby said composite multicolor picture image comprises at least three toner picture images of at least three different colors.

20. A method as set forth in claim 17, wherein:

said container is fabricated from a material chosen from the group of metal, glass, plastic, and paper.

21. A method as set forth in claim 17, wherein:

said container is heated by means of an induction heating process so as to transfer said multicolor picture image from said belt to said container.

22. A method as set forth in claim 17, further comprising the step of:

coating said multicolor picture image surface of said container with a varnish finish, after said multicolor picture image has been transferred from said belt to said container, so as to protect said multicolor picture image fixed upon said container.

23. A method as set forth in claim 18, further comprising the step of:

disposing multiple charging, exposing, and developing means at circumferentially spaced locations with respect to said tubular photoconductive drum so as to achieve formation of said composite multicolor picture image upon said photoconductive drum.

24. A method as set forth in claim 17, further comprising the steps of:

forming said belt as an endless annular belt having a circular locus;

providing a plurality of containers upon an indexable rotary table; and intermittently rotating said belt along said circular locus in correspondence with an indexable movement of said rotary table so as to achieve said transfer of said multicolor picture images from said belt to said containers in a serial production manner.

* * * * *